US011212621B2

(12) United States Patent
Loeppert et al.

(10) Patent No.: US 11,212,621 B2
(45) Date of Patent: Dec. 28, 2021

(54) COMPOSITE DIAPHRAGMS HAVING BALANCED STRESS

(71) Applicant: Knowles Electronics, LLC, Itasca, IL (US)

(72) Inventors: Peter V. Loeppert, Durand, IL (US); Sung Bok Lee, Chicago, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/887,822

(22) Filed: May 29, 2020

(65) Prior Publication Data

US 2021/0168515 A1 Jun. 3, 2021

(30) Foreign Application Priority Data

Nov. 29, 2019 (CN) ..... 201922113332.1

(51) Int. Cl.
*H04R 11/04* (2006.01)
*H04R 7/06* (2006.01)

(52) U.S. Cl.
CPC ..... *H04R 11/04* (2013.01); *H04R 7/06* (2013.01); *H04R 2231/003* (2013.01); *H04R 2307/025* (2013.01)

(58) Field of Classification Search
None
See application file for complete search history.

(56) References Cited

U.S. PATENT DOCUMENTS 6,622,368 B1 * 9/2003 Mullenborn ..... H04R 31/003 29/25.41
2012/0045078 A1 2/2012 Lander
2013/0062710 A1 * 3/2013 Dehe ..... B81C 1/00476 257/415
2015/0016656 A1 1/2015 Chen
2015/0109889 A1 4/2015 Chen
2016/0167960 A1 * 6/2016 Giesen ..... G01L 9/0073 438/10
2016/0341619 A1 11/2016 Dehe
2018/0052042 A1 * 2/2018 Dehe ..... H01L 41/0836

FOREIGN PATENT DOCUMENTS

KR 101353590 1/2014

OTHER PUBLICATIONS

Kang, International Search Report, International Application No. PCT/US2019/062964, Korean Intellectual Property Office, Daejeon, Republic of Korea, dated Apr. 7, 2020.

* cited by examiner

*Primary Examiner* — Walter F Briney, III
(74) *Attorney, Agent, or Firm* — Loppnow & Chapa; Matthew C. Loppnow

(57) ABSTRACT

An acoustic transducer comprises a transducer substrate defining an aperture therein. A diaphragm is disposed on the transducer substrate. The diaphragm comprises a diaphragm inner portion disposed over the aperture such that an outer edge of the diaphragm inner portion is located radially inwards of a rim of the aperture, the diaphragm inner portion having a first stress. A diaphragm outer portion extends radially from the outer edge of the diaphragm inner portion to at least the rim of the aperture, the diaphragm outer portion having a second stress different from the first stress.

20 Claims, 5 Drawing Sheets

COMPOSITE DIAPHRAGMS HAVING BALANCED STRESS

CROSS-REFERENCE TO RELATED APPLICATIONS

This application claims the priority benefit of Chinese patent application no. 201922113332.1, filed on Nov. 29, 2019 and incorporated herein by reference in its entirety.

TECHNICAL FIELD

The present disclosure relates generally to systems and methods of increasing compliance of diaphragms used in acoustic transducers.

BACKGROUND

Microphone assemblies are used in electronic devices to convert acoustic energy to electrical signals. Advancements in micro and nanofabrication technologies have led to the development of progressively smaller micro-electro-mechanical-system (MEMS) microphone assemblies. Some microphone assemblies include acoustic transducers that have a diaphragm. Some diaphragms can have inherent tensile stress which makes it difficult to control the microphone sensitivity.

SUMMARY

Embodiments described herein relate generally to systems and methods for decreasing stress in diaphragms of acoustic transducers, and in particular to acoustic transducers that include a diaphragm including an outer portion and an inner portion having different stresses such that an overall tensile stress of the diaphragm is substantially reduced.

In some embodiments, an acoustic transducer comprises a transducer substrate defining an aperture therein and a diaphragm disposed on the transducer substrate. The diaphragm comprises a diaphragm inner portion disposed over the aperture such that an outer edge of the diaphragm inner portion is located radially inwards of a rim of the aperture, the diaphragm inner portion having a first stress, and a diaphragm outer portion extending radially from the outer edge of the diaphragm inner portion to at least the rim of the aperture, the diaphragm outer portion having a second stress different from the first stress. A back plate is disposed on the transducer substrate spaced apart from the diaphragm.

In some embodiments, a microphone assembly comprises a base, an enclosure disposed on the base; an acoustic transducer configured to generate an electrical signal responsive to acoustic activity. The acoustic transducer comprises a transducer substrate defining an aperture therein, and a diaphragm disposed on the transducer substrate. The diaphragm comprises a diaphragm inner portion disposed over the aperture such that an outer edge of the diaphragm inner portion is located radially inwards of a rim of the aperture, the diaphragm inner portion having a first stress, and a diaphragm outer portion extending radially from the outer edge of the diaphragm inner portion to at least the rim of the aperture, the diaphragm outer portion having a second stress different from the first stress. A back plate is disposed on the transducer substrate spaced apart from the diaphragm, and an integrated circuit is electrically coupled to the acoustic transducer and configured to receive the electrical signal from the acoustic transducer.

In some embodiments, a method of forming a diaphragm assembly comprises providing a transducer substrate defining an aperture therethrough; forming a diaphragm outer portion on the transducer substrate over the aperture; and forming a diaphragm inner portion over the aperture coupled to the diaphragm outer portion such that an outer edge of the diaphragm inner portion is located radially inwards of a rim of the aperture and the diaphragm outer portion extends radially from the outer edge of the diaphragm inner portion to at least the rim of the aperture. The diaphragm inner portion has a first stress and the diaphragm outer portion has a second stress different from the first stress.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1A:
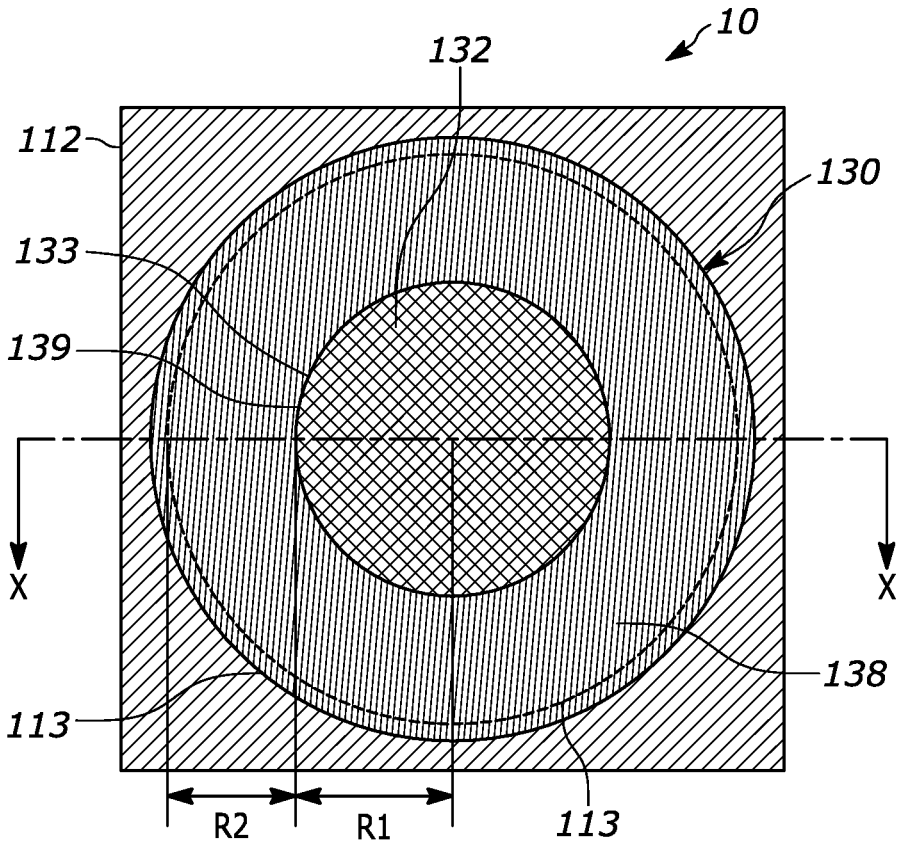
FIG. 1A is top plan view of a diaphragm assembly.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION OF VARIOUS EMBODIMENTS

Embodiments described herein relate generally to systems and methods for decreasing stress in diaphragms of acoustic transducers, and in particular to acoustic transducers that include a diaphragm including an outer portion and an inner portion having different stresses such that an overall tensile stress of the diaphragm is substantially reduced.

Small MEMS microphone assemblies have allowed incorporation of such microphone assemblies in compact devices such as cell phones, laptops, wearables, TV/set-top box remotes, etc. Some microphone assemblies include acoustic transducers that have a diaphragm, such as a constrained or tensioned diaphragm. The sensitivity of a microphone having a constrained diaphragm varies with the tension. Lower values of tension are desirable since this results in increased sensitivity but are also problematic since the process control of the tension at low values is poor.

Various techniques may be used to reduce the tensile stress in such diaphragms. For example, a constrained diaphragm may be formed from a single conductive material (e.g., polysilicon) and the stress thereof controlled during the fabrication process. However, it is difficult to produce tensile diaphragms from such material and control the stress thereof. Another option is to form a layered diaphragm including a layer of tensile material (e.g., silicon nitride) and another layer of a compressive material (e.g., a polysilicon). The stress of the individual layers is balanced to achieve a desired compliance. However, this results in a bi-morph diaphragm which is prone to bowing. Still another option is to form a layered diaphragm including a layer of compressive material interposed between layers of tensile material, or alternatively, a layer of tensile material interposed between layers of compressive material, and control a stress of each material to balance stress and reduce bowing. However, controlling the stress of three layers is very complex.

In contrast, embodiments of the diaphragm assemblies and acoustic transducers described herein may provide one or more benefits including, for example: (1) reducing tensile stress in a diaphragm by providing an outer portion having a first stress and an inner portion having a second stress different from the first stress such that a tensile stress of the diaphragm is decreased and a compliance of the diaphragm is increased; (2) reducing bow in the diaphragm by avoiding use of multilayered diaphragms; and/or (3) allowing reduction in stress of constrained diaphragms without increase in fabrication complexity thereof.

Figure 1B:
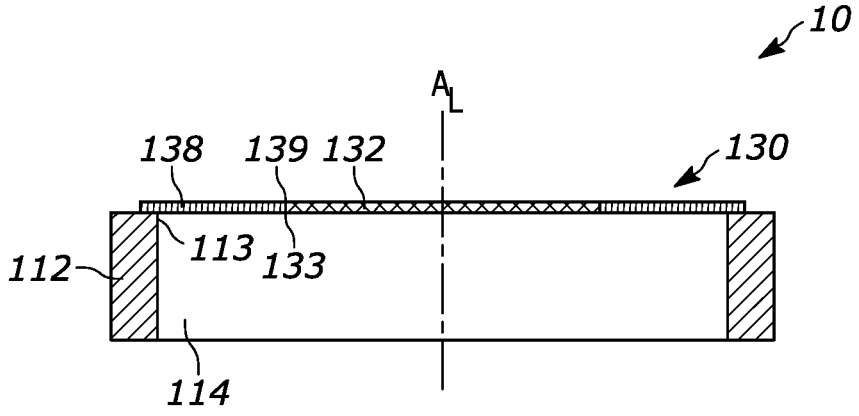
FIG. 1B is a side cross-section view of the diaphragm assembly of FIG. 1A taken along the line X-X in FIG. 1A, according to an embodiment.

FIG. 1A is a top plan view and FIG. 1B is a side cross-section view of a diaphragm assembly 10, according to an embodiment. The diaphragm assembly 10 may be included in an acoustic transducer (e.g., the acoustic transducer 310) of a microphone assembly (e.g., the microphone assembly 400).

The diaphragm assembly 10 includes a transducer substrate 112 defining an aperture 114 therein. In some embodiments, the transducer substrate 112 may be formed from silicon, glass, ceramics, or any other suitable material. In some embodiments, the aperture 114 may define a circular cross-section as shown in FIG. 1A.

A diaphragm 130 is disposed on the transducer substrate 112 over the aperture 114 about a longitudinal axis $A_L$ of the diaphragm assembly 10. The diaphragm 130 comprises a diaphragm inner portion 132 disposed over the aperture 114 such that an outer edge 133 of the diaphragm inner portion 132 is located radially inwards of a rim 113 of the aperture 114. In other words, the diaphragm inner portion 132 has a cross-section (e.g., diameter) which is smaller than a cross-section (e.g., diameter) of the aperture 114, such that the diaphragm inner portion 132 is positioned within the radial extents of the aperture 114.

A diaphragm outer portion 138 extends radially from the outer edge 133 of the diaphragm inner portion 132 to at least the rim 113 of the aperture 114. In other words, the diaphragm outer portion 138 includes an annular structure such that the diaphragm inner portion 132 is disposed within an annular opening of the diaphragm outer portion 138 and coupled thereto. As shown in FIG. 1A and 1B, the diaphragm outer portion 138 extends over the rim 113 of the aperture 114 such that a portion of the diaphragm outer portion 138 is disposed on the transducer substrate 112. In other embodiments, the diaphragm outer portion 138 may only extend to the rim 113 of the aperture 114 and be coupled thereto.

The diaphragm inner portion 132 has a first stress and the diaphragm outer portion 138 has second stress different from the first stress. The different stresses are selected such that an overall tensile stress of the diaphragm 130 is reduced, resulting in reduced bowing and increased compliance. The net or overall stress of the diaphragm 130 could be determined using simulations, or experimental tests (e.g., via a laser vibrometer or any other suitable testing equipment). In some embodiments, the net stress of the diaphragm 130 is tensile.

Expanding further, in some embodiments, the second stress of the diaphragm outer portion 138 may include a tensile stress. For example, the diaphragm outer portion 138 may be formed from silicon nitride having the tensile second stress. To balance the second stress of the diaphragm outer portion 138, the diaphragm inner portion 132 may have a compressive stress. For example, the diaphragm inner portion 132 may be formed from polysilicon so as to provide a compressive stress which counteracts and balances the tensile stress of the diaphragm outer portion 138. The tensile second stress of the diaphragm outer portion 138 causes it to contract, while the compressive first stress of the diaphragm inner portion 132 causes it to expand. In this manner, the tensile second stress is balanced by the compressive first stress, thus reducing the overall tensile stress of the diaphragm 130.

In still other embodiments, the first stress may be a tensile stress and the second stress may include a compressive stress. In such embodiments, the diaphragm inner portion 132 may be formed from silicon nitride and the diaphragm outer portion 138 may be formed from polysilicon. In such embodiments, a conductive lead may be extend from the diaphragm inner portion 132 over the diaphragm outer portion 138 to a periphery of the diaphragm 130 where it may be coupled to an electrical contact.

The diaphragm inner portion 132 and the diaphragm outer portion 138 may have the same or different thicknesses, for example, to partially balance the first stress and second stress thereof. For example, increasing the thickness of the diaphragm outer portion 138 provides a higher compensating force to balance a larger compressive stress in the diaphragm inner portion 132. In some implementations, the thickness of the diaphragm inner and outer portions 132, 138 may range from 0.1-10 microns. In some embodiments, the net stress of the diaphragm 130 may be controlled by controlling radial extents of the diaphragm inner portion 132, and radial extents of the diaphragm outer portion 138 to the rim 113 (i.e., radial extents of the suspended portion of the diaphragm outer portion 138). For example, as shown in FIG. 1A, a first radial distance R1 from a center of the diaphragm inner portion 132 (e.g., from the longitudinal axis $A_L$) to the outer edge 133 of the diaphragm inner portion 132, and a second radial distance R2 from the inner edge 139 of the diaphragm outer portion 138 to the rim 113 of the aperture 114 may be selected such that a total tensile stress of the diaphragm 130 is less than 10 MPa. This is a substantial reduction in the overall tensile stress of the diaphragm 130 relative to a conventional constrained diaphragm that includes a single tensile layer (such as a silicon nitride diaphragm), and generally have a tensile stress of greater than 10 MPa. In some embodiments, the net stress of the diaphragm 130, when the diaphragm outer and inner portions 132 and 138 have the same thickness, may be determined by the following equation:

$$(R2\times\text{Second stress}+R1\times\text{First stress})/(R1+R2)=\text{Overall diaphragm stress}$$

According to various embodiments, the diaphragm 130 is made of a single piece or layer of material, in which the outer and inner portions have each been doped to different extents, such that the diaphragm inner portion 132 is tensile and the diaphragm outer portion 138 is compressive, or such that the diaphragm inner portion 132 is compressive and the diaphragm outer portion 138 is tensile. In one embodiment, the diaphragm 130 is made of a single piece of polycrystalline silicon ("polysilicon"), in which the inner portion 132 is doped sufficiently (e.g., with phosphorous) and annealed to make the stress of the inner portion 132 tensile, and the outer portion 138 is doped and annealed with a different schedule (e.g., with Rapid Thermal Annealing) sufficiently to make the outer portion 138 conductive, but not enough to make the outer portion 138 tensile (i.e., leaving the stress of the outer portion compressive or neutral).

In an embodiment, the diaphragm 130 is formed using a method that includes: providing a single piece of polysilicon (which constitutes the diaphragm 130), doping the inner portion 132 with phosphorous to the solid solubility limit (plus or minus 75%), and doping the outer portion 138 with phosphorous sufficient to make the outer portion 138 conductive but not enough to make the outer portion 138 tensile.

Figure 2A:
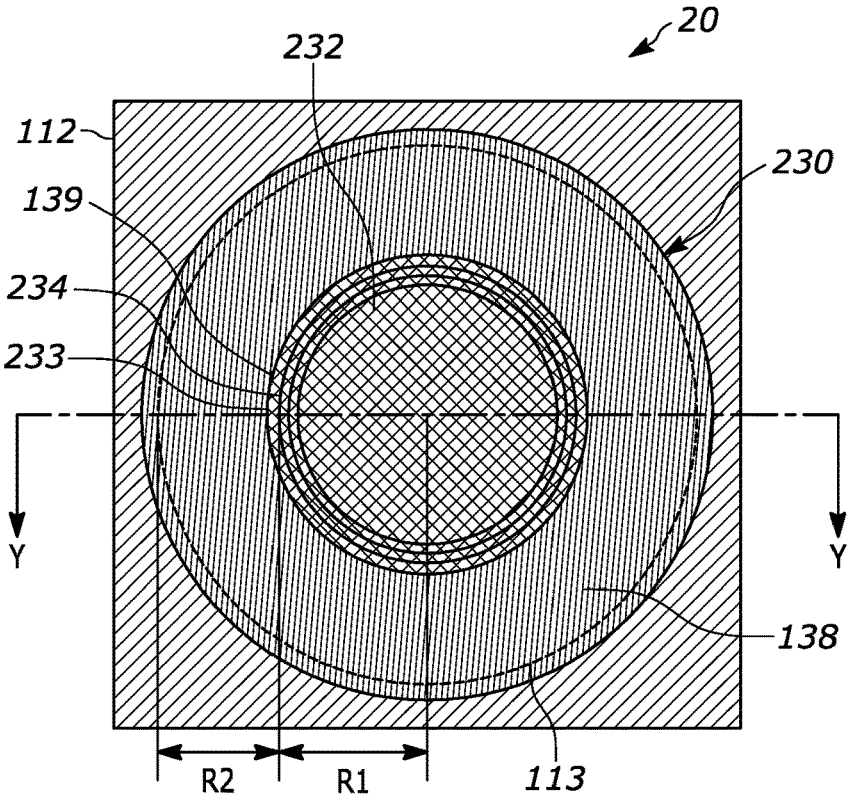
FIG. 2A is top plan view of a diaphragm assembly.
Figure 2B:
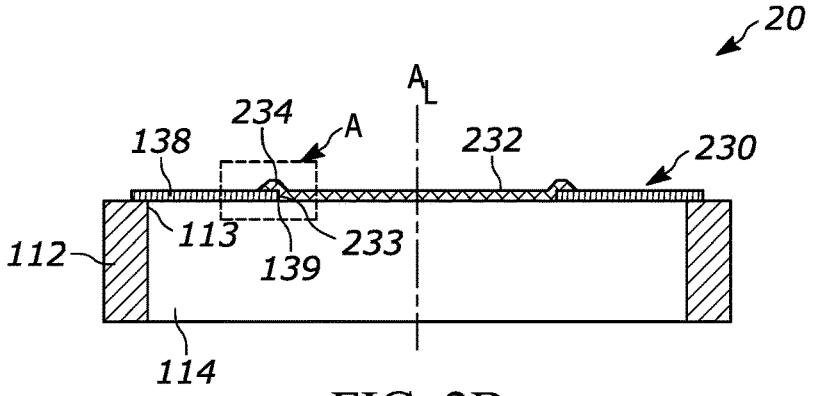
FIG. 2B is a side cross-section view of the diaphragm assembly of FIG. 2A taken along the line Y-Y in FIG. 2A, according to an embodiment.

FIG. 2A is a top plan view and FIG. 2B is a side cross-section view of a diaphragm assembly 20, according to another embodiment. The diaphragm assembly 20 includes the transducer substrate 112 defining the aperture 114. A diaphragm 230 is disposed on the transducer substrate 112. The diaphragm 230 includes a diaphragm inner portion 232 and the diaphragm outer portion 138, as described previously with respect to the diaphragm assembly 10.

Figure 2C:
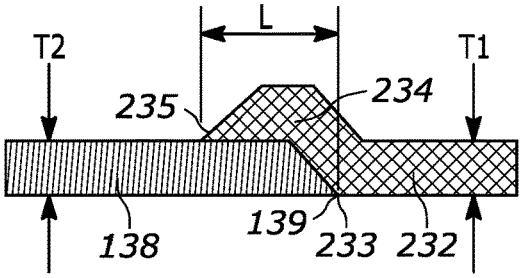
FIG. 2C is a side cross-section view of a portion of the diaphragm assembly of FIG. 2A-2B, indicated by the arrow A in FIG. 2B.

FIG. 2C shows a portion of the diaphragm assembly 20 shown by the arrow A in FIG. 2B. The diaphragm inner portion 232 is substantially similar to the diaphragm inner portion 132. However, different from the diaphragm inner portion 132, the diaphragm inner portion 232 includes an overlapping portion 234 extending from an outer edge 233 of the diaphragm inner portion 232 and overlaps the inner edge 139 of the diaphragm outer portion 138. In some embodiments, a first thickness T1 of the diaphragm inner portion 232 is approximately equal (e.g., in a range of 95% to 105%) to a second thickness T2 of the diaphragm outer portion 138. In such embodiments, the diaphragm inner and outer portions 232, 138 are located along approximately the same plane (not considering any bowing of the diaphragm 230) and, the overlapping portion 234 is located above the plane thereof. In other words, the overlapping portion 234 is located above an upper surface of the diaphragm outer portion 238. In some embodiments, a radial length L of the overlapping portion 234 measured from the inner edge 139 of the diaphragm outer portion 138 to an outer edge 235 of the overlapping portion 234 is in a range of 3 to 10 times the thickness T2 of the diaphragm outer portion 138. In various embodiments, the first thickness T1 and the second thickness T2 may be in a range of 0.1-10 microns.

While embodiments herein generally describe each of the diaphragm outer portion (e.g., the diaphragm outer portion 138) and diaphragm inner portion (e.g., the diaphragm inner portion 132, 232) as including a single layer, in other embodiments, the diaphragm inner and/or outer portions may include a stack of layers (e.g., two or three layers).

Figure 3:
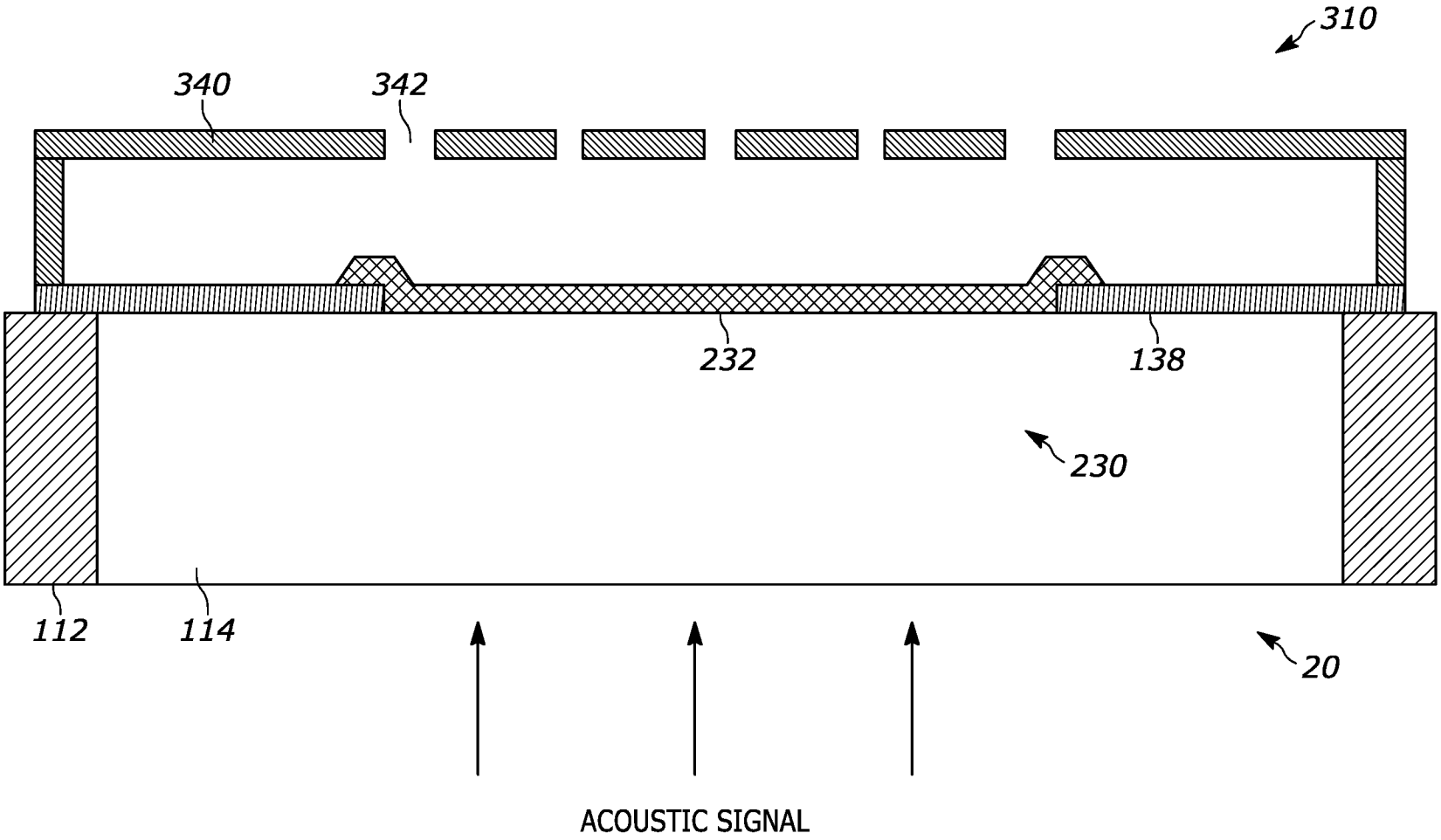
FIG. 3 is a side cross-section view of an acoustic transducer that includes the diaphragm assembly of FIGS. 2A-2B, according to an embodiment.

The diaphragm assembly 10 or 20 may be included in an acoustic transducer. For example, FIG. 3 is a side cross-section view of an acoustic transducer 310, according to an embodiment. The acoustic transducer 310 includes the diaphragm assembly 20, as previously described herein. Furthermore, the acoustic transducer 310 includes a back plate 340 disposed over the transducer substrate 112 above the diaphragm 230 such that the back plate 340 is spaced apart from the diaphragm 230. A plurality of apertures 342 are defined in the back plate 340.

The back plate 340 may be formed from polysilicon, silicon nitride, other suitable materials (e.g., silicon oxide, silicon, ceramics, etc.), or sandwiches thereof. Vibrations of the diaphragm 230 relative to the back plate 340 which is substantially fixed (e.g., substantially inflexible relative to the diaphragm 230) in response to acoustic signals received on the diaphragm 230 causes changes in the capacitance between the diaphragm 230 and the back plate 340, and corresponding changes in the generated electrical signal.

While the back plate 340 is disposed above the diaphragm 230 as shown in FIG. 3, in other embodiments the back plate 340 may be disposed below the diaphragm 230, or the back plate 340 may be disposed between a first and second diaphragm each of which includes the diaphragm 230 in a dual diaphragm acoustic transducer, or any other acoustic transducer. While described herein with respect to acoustic transducers, it should be understood that the diaphragms 130, 230 or any other diaphragms described herein may be used in any implementation as a replacement for other diaphragm structures.

Figure 4:
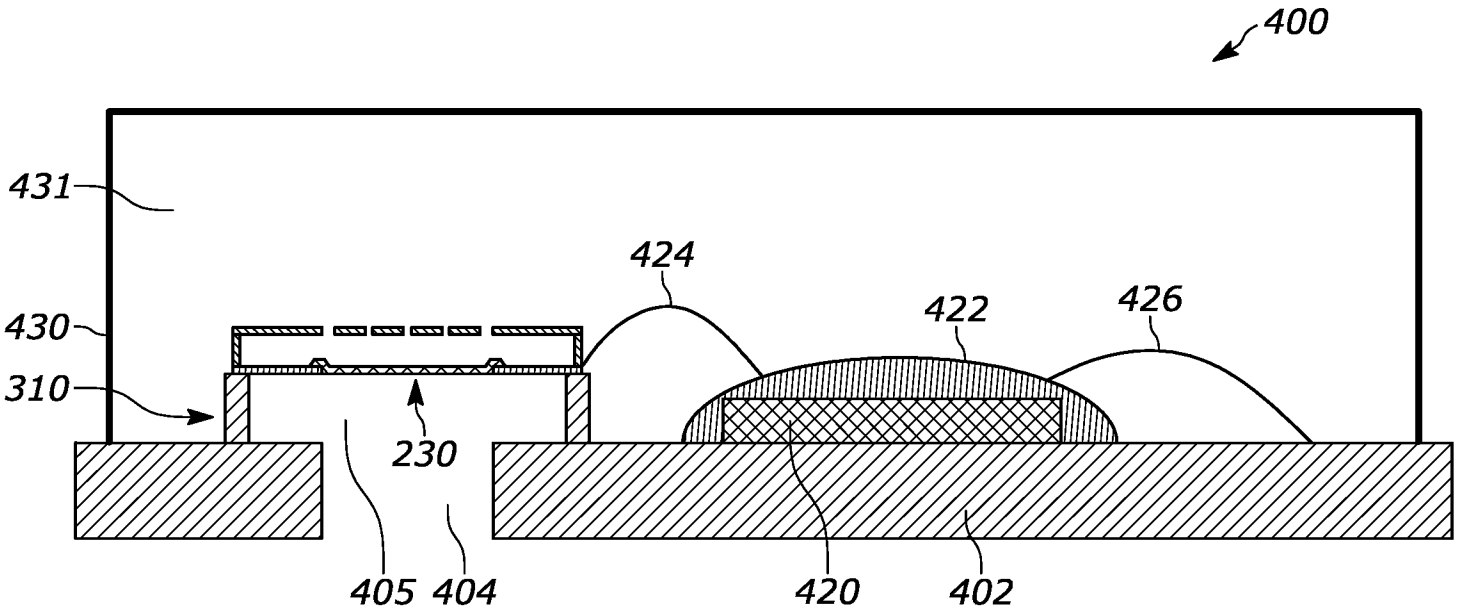
FIG. 4 is a side cross-section view of microphone assembly including the acoustic transducer of FIG. 3, according to an embodiment.

In some embodiments, the acoustic transducer 310 or any other acoustic transducer described herein may be included in a microphone assembly. For example, FIG. 4 is a side cross-section view of a microphone assembly 400, according to a particular embodiment. The microphone assembly 400 may be used for converting acoustic signals into electrical signals in any device such as, for example, cell phones, laptops, TV/set top box remotes, tablets, audio systems, head phones, wearables, portable speakers, car sound systems or any other device which uses a microphone assembly.

The microphone assembly 400 comprises a base 402, the acoustic transducer 310, an integrated circuit 420 and an enclosure or cover 430. The base 402 can be formed from materials used in printed circuit board (PCB) fabrication (e.g., plastics). For example, the base 402 may include a PCB configured to mount the acoustic transducer 310, the integrated circuit 420 and the enclosure 430 thereon. A sound port 404 is formed through the base 402. The acoustic transducer 310 is positioned on the sound port 404, and is configured to generate an electrical signal responsive to an acoustic signal received through the sound port 404.

In FIG. 4, the acoustic transducer 310 and the integrated circuit 420 are shown disposed on a surface of the base 402, but in other embodiments one or more of these components may be disposed on the enclosure 430 (e.g., on an inner surface of the enclosure 430) or sidewalls of the enclosure 430 or stacked atop one another. In some embodiments, the base 402 includes an external-device interface having a plurality of contacts coupled to the integrated circuit 420, for example, to connection pads (e.g., bonding pads) which may be provided on the integrated circuit 420. The contacts may be embodied as pins, pads, bumps or balls among other known or future mounting structures. The functions and number of contacts on the external-device interface depend on the protocol or protocols implemented and may include power, ground, data, and clock contacts among others. The external-device interface permits integration of the microphone assembly 400 with a host device using reflow-soldering, fusion bonding, or other assembly processes.

As shown in FIG. 4, the diaphragm 230 separates a front volume 405 defined between the diaphragm 230 and the sound port 404, from a back volume 431 of the microphone assembly 400 between the enclosure 430 and diaphragm 230. The embodiment shown in FIG. 4 includes a bottom port microphone assembly 400 in which the sound port 404 is defined in the base 402 such that the internal volume 431 of the enclosure 430 defines the back volume. It should be appreciated that in other embodiments, the concepts described herein may be implemented in a top port microphone assembly in which a sound port is defined in the enclosure 430 of the microphone assembly 400.

In some embodiments, a pierce or throughhole is defined through the diaphragm 230 to provide pressure equalization between the front and back volumes 405, 431. In other embodiments, a vent may be defined in the enclosure 430 to allow pressure equalization.

The integrated circuit 420 is positioned on the base 402. The integrated circuit 420 is electrically coupled to the acoustic transducer 310, for example, via a first electrical lead 324 and also to the base 402 (e.g., to a trace or other electrical contact disposed on the base 402) via a second electrical lead 426. The integrated circuit 420 receives an electrical signal from the acoustic transducer 310 and may amplify and condition the signal before outputting a digital or analog electrical signal as is known generally. The integrated circuit 420 may also include a protocol interface (not shown), depending on the output protocol desired. The integrated circuit 420 may also be configured to permit programming or interrogation thereof as described herein. Exemplary protocols include but are not limited to PDM, PCM, SoundWire, I2C, I2S and SPI, among others.

The integrated circuit 420 may include one or more components, for example, a processor, a memory, and/or a communication interface. The processor may be implemented as one or more general-purpose processors, an application specific integrated circuit (ASIC), one or more field programmable gate arrays (FPGAs), a digital signal processor (DSP), a group of processing components, or other suitable electronic processing components. In other embodiments, the DSP may be separate from the integrated circuit 420 and in some implementations, may be stacked on the integrated circuit 420. In some embodiments, the one or more processors may be shared by multiple circuits and, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. All such variations are intended to fall within the scope of the present disclosure. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on.

A protective coating 422 may be disposed on the integrated circuit 420, in some implementations. The protective coating 422 may include, for example a silicone gel, a laminate, or any other protective coating configured to protect the integrated circuit 420 from moisture and/or temperature changes.

The enclosure 430 is positioned on the base 402. The enclosure 430 defines the internal volume 431 within which at least the integrated circuit 420 and the acoustic transducer 310 is positioned. For example, as shown in FIG. 4, the enclosure 430 is positioned on the base 402 such that the base 402 forms a base of the microphone assembly 400, and the base 402 and the enclosure 430 cooperatively define the internal volume 431. As previously described herein, the internal volume 431 defines the back volume of the microphone assembly 400.

The enclosure 430 may be formed from a suitable material such as, for example, metals (e.g., aluminum, copper, stainless steel, etc.), and may be coupled to the base 402, for example, via an adhesive, soldered or fusion bonded thereto.

Figure 5:
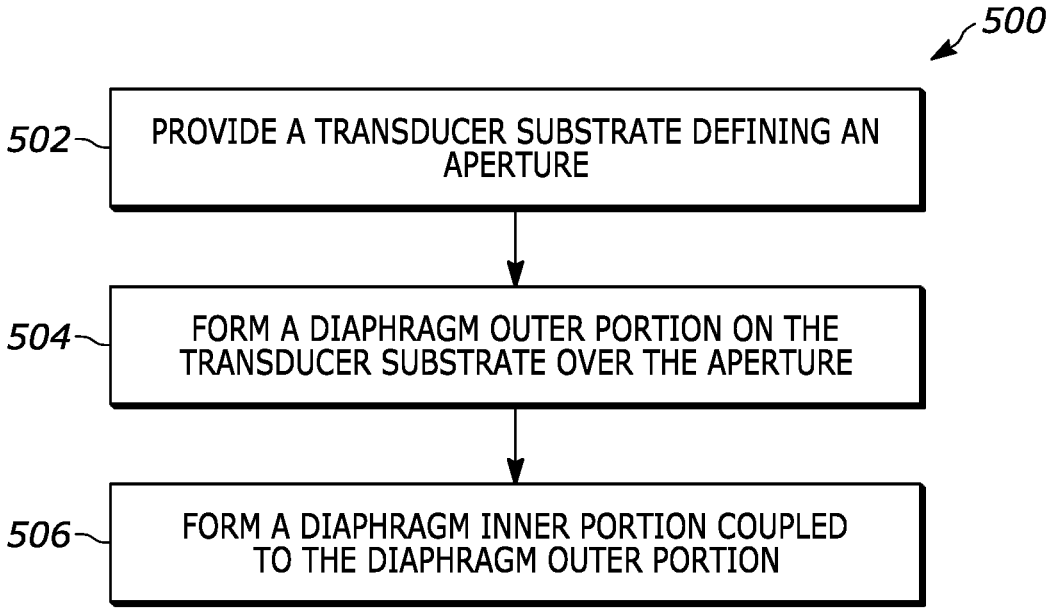
FIG. 5 is a schematic flow diagram of a method of forming an acoustic transducer, according to an embodiment.

FIG. 5 is a schematic flow diagram of a method 500 of forming a diaphragm assembly (e.g., the diaphragm assembly 10, 20), according to an embodiment. The method 500 includes providing a transducer substrate defining an aperture therethrough, at 502. For example, the transducer substrate may include the transducer substrate 112 defining the aperture 114 therethrough.

At 504, a diaphragm outer portion is formed on the transducer substrate over the aperture. For example, the diaphragm outer portion 138 is formed on the transducer substrate 112 via a deposition process such as chemical vapor deposition (CVD), plasma enhanced CVD (PECVD), low pressure CVD (LPCVD), or any other deposition technique. The diaphragm outer portion extends over the aperture 114. In some embodiments, a sacrificial material (e.g., silicon oxide, etc.) may be disposed on the surface of the substrate 112 to provide an etch stop when forming the aperture 114 and an etch stop when etching a radially inner region of the diaphragm outer portion 138. The diaphragm outer portion defines an annulus or opening.

At 506, a diaphragm inner portion is formed over the aperture coupled to the diaphragm outer portion so as to form a diaphragm on the transducer substrate. For example, the diaphragm inner portion 132, 232 is formed (e.g., deposited via CVD, PECVD, LPCVD or any other suitable method) over the aperture 114 so as to be coupled to the diaphragm outer portion 138, 238, for example, via adhesion of a portion of the thin film forming the diaphragm inner portion 132, 232 (e.g., polysilicon) that overlaps or otherwise contacts the thin film forming the diaphragm outer portion 138, 238 (e.g., silicon nitride). The overlapping or otherwise contacting portions of the diaphragm outer portions 138, 238 and inner portions 132, 232 inherently adhere to each other such that a separate adhesive material is not used. To promote adhesion, the diaphragm outer portion 138, 238 may be subjected to a surface cleaning process before depositing the diaphragm inner portion 132, 232. In some implementations, such a cleaning process may create an active surface on the surface of the diaphragm outer portion 138, 238 which readily bonds with the contacting portion of the diaphragm inner portion 132, 232 so as to enable coupling thereto.

The diaphragm inner portion 132 and may be deposited over the sacrificial material. The sacrificial material is later etched away to release the diaphragm 130, 230. The outer edge 133 of the diaphragm inner portion 132 is located radially inwards of the rim 113 of the aperture 114 and the diaphragm outer portion 138 extends radially from the outer edge 133 of the diaphragm inner portion 132 to at least the rim 113 of the aperture 114.

The diaphragm inner portion (e.g., the diaphragm inner portion 132, 232) has a first stress and the diaphragm outer portion (e.g., the diaphragm outer portion138) has a second stress different from the first stress. In some embodiments, the first stress is a compressive stress and the second stress is a tensile stress. In such embodiments, the diaphragm inner portion comprises polysilicon and the diaphragm outer portion comprises silicon nitride. In still other embodiments, the diaphragm outer portion may have a compressive stress and the diaphragm inner portion may have a tensile stress.

In some embodiments, a first radial distance (e.g., the first radial distance R1) from a center point of the diaphragm inner portion (e.g., the diaphragm inner portion 132, 232) to the outer edge of the diaphragm inner portion, and a second radial distance (e.g., the second radial distance R2) from an inner edge of the diaphragm outer portion (e.g., the diaphragm outer portion 138) to a rim of the aperture are selected such that a total tensile stress of the diaphragm is less than 10 MPa, as previously described herein. In some embodiments, a first thickness of the diaphragm inner portion is in a range of 95% to 105% of a second thickness of the diaphragm outer portion. In other embodiment, the thicknesses may be different, for example, to produce a desired net diaphragm stress for a desired ratio of R1 to R2.

In some embodiments, the deposition parameters for the thin films forming the inner and outer portions (e.g., the diaphragm inner and outer portions 132 and 138) of the diaphragm are chosen to provide the tightest stress tolerance, and the geometry (e.g., the first and second radial distances R1 and R2) is used to control the net stress in the diaphragm.

In some embodiments, the diaphragm inner portion (e.g., the diaphragm inner portion 232) includes an overlapping portion (e.g., the overlapping portion 234) extending from the outer edge of the diaphragm inner portion to overlap an inner edge of the diaphragm outer portion (e.g., the diaphragm outer portion 138). In particular embodiments, a radial length of the overlapping portion measured from the inner edge if the diaphragm outer portion to an outer edge of the overlapping portion is in a range of 3 to 10 times a thickness of the diaphragm outer portion.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

As used herein, the terms "approximately" generally mean plus or minus 10% of the stated value. For example, about 0.5 would include 0.45 and 0.55, about 10 would include 9 to 11, about 1000 would include 900 to 1100.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An acoustic transducer, comprising:

a transducer substrate defining an aperture therein;

a diaphragm disposed on the transducer substrate, the diaphragm comprising:

a diaphragm inner portion disposed over the aperture such that an outer edge of the diaphragm inner portion is located radially inwards of a rim of the aperture, the diaphragm inner portion having a first stress, and a diaphragm outer portion extending radially from the outer edge of the diaphragm inner portion to at least the rim of the aperture, the diaphragm outer portion having a second stress different from the first stress; and a back plate disposed on the transducer substrate spaced apart from the diaphragm.

2. The acoustic transducer of claim 1, wherein the first stress is a compressive stress and the second stress is a tensile stress.

3. The acoustic transducer of claim 2, wherein the diaphragm inner portion comprises polysilicon and the diaphragm outer portion comprises silicon nitride.

4. The acoustic transducer of claim 1, wherein the first stress is a tensile stress and the second stress is a compressive stress.

5. The acoustic transducer of claim 1, wherein:

the diaphragm is a single piece of polysilicon, the diaphragm inner portion is doped and annealed sufficiently to make the first stress a tensile stress, and the second stress is a compressive stress.

6. The acoustic transducer of claim 1, wherein a total net stress of the diaphragm is tensile.

7. The acoustic transducer of claim 1, wherein the diaphragm inner portion includes an overlapping portion extending from the outer edge of the diaphragm inner portion to overlap an inner edge of the diaphragm outer portion.

8. A microphone assembly, comprising:

a base;

an enclosure disposed on the base;

an acoustic transducer configured to generate an electrical signal responsive to acoustic activity, the acoustic transducer comprising:

a transducer substrate defining an aperture therein, a diaphragm disposed on the transducer substrate, the diaphragm comprising:

a diaphragm inner portion disposed over the aperture such that an outer edge of the diaphragm inner portion is located radially inwards of a rim of the aperture, the diaphragm inner portion having a first stress, and a diaphragm outer portion extending radially from the outer edge of the diaphragm inner portion to at least the rim of the aperture, the diaphragm outer portion having a second stress different from the first stress; and a back plate disposed on the transducer substrate spaced apart from the diaphragm; and an integrated circuit electrically coupled to the acoustic transducer and configured to receive the electrical signal from the acoustic transducer.

9. The microphone assembly of claim 8, wherein the first stress is a compressive stress and the second stress is a tensile stress.

10. The microphone assembly of claim 9, wherein the diaphragm inner portion comprises polysilicon and the diaphragm outer portion comprises silicon nitride.

11. The microphone assembly of claim 8, wherein the first stress is a tensile stress and the second stress is a compressive stress.

12. The microphone assembly of claim 8, wherein:

the diaphragm is a single piece of polysilicon, the diaphragm inner portion is doped and annealed sufficiently to make the first stress a tensile stress, and the second stress is a compressive stress.

13. The microphone assembly of claim 8, wherein a total net stress of the diaphragm tensile.

14. The microphone assembly of claim 8, at least one of the diaphragm inner portion and the diaphragm outer portion comprise a plurality of layers.

15. The microphone assembly of claim 8, wherein the diaphragm inner portion includes an overlapping portion extending from the outer edge of the diaphragm inner portion to overlap an inner edge of the diaphragm outer portion.

16. A method of forming a diaphragm assembly, comprising:

providing a transducer substrate defining an aperture therethrough;

forming a diaphragm outer portion on the transducer substrate over the aperture; and forming a diaphragm inner portion over the aperture coupled to the diaphragm outer portion such that an outer edge of the diaphragm inner portion is located radially inwards of a rim of the aperture and the diaphragm outer portion extends radially from the outer edge of the diaphragm inner portion to at least the rim of the aperture, wherein the diaphragm inner portion has a first stress and the diaphragm outer portion has a second stress different from the first stress.

17. The method of claim 16, wherein the first stress is a compressive stress and the second stress is a tensile stress.

18. The method of claim 16, wherein the first stress is a tensile stress and the second stress is a compressive stress.

19. The method of claim 16, further comprising:

providing a single piece of polysilicon, wherein forming the diaphragm inner portion comprises doping and annealing the inner portion sufficiently to make the first stress a tensile stress, and wherein the second stress is a compressive stress.

20. The method of claim 16, wherein the forming the diaphragm inner portion causes the diaphragm inner portion to have an overlapping portion extending from the outer edge of the diaphragm inner portion to overlap an inner edge of the diaphragm outer portion, the diaphragm inner portion coupled to the diaphragm outer portion at the overlap portion.

* * * * *